US006772994B1

(12) United States Patent
Lawless

(10) Patent No.: US 6,772,994 B1
(45) Date of Patent: Aug. 10, 2004

(54) PRY BAR HANDLE

(75) Inventor: John C. Lawless, Charlemont, MA (US)

(73) Assignee: Mayhew Tool Products, Turners Falls, MA (US)

( * ) Notice: Subject to any disclaimer, the term of this patent is extended or adjusted under 35 U.S.C. 154(b) by 0 days.

(21) Appl. No.: 10/420,432

(22) Filed: Apr. 22, 2003

(51) Int. Cl.[7] ..... B25C 11/00
(52) U.S. Cl. ..... 254/25; 254/28
(58) Field of Search ..... 254/25, 28, 131; 29/267, 278, 270; 81/177.1, 177.4, 177.8, 438, 439, 490, 489; 16/110.1, 421, 430, 431, 436

(56) References Cited

U.S. PATENT DOCUMENTS

| | | | | | |
|---|---|---|---|---|---|
| 3,825,226 | A | * | 7/1974 | Appleman | 254/28 |
| 4,451,024 | A | | 5/1984 | Shepherd | |
| 4,712,304 | A | | 12/1987 | Sanelli | |
| 5,042,804 | A | * | 8/1991 | Uke et al. | 81/489 |
| 5,046,387 | A | | 9/1991 | Levake | |
| 5,259,277 | A | * | 11/1993 | Zurbuchen | 81/177.1 |
| 5,390,572 | A | | 2/1995 | Gakbar et al. | |
| 5,475,894 | A | * | 12/1995 | Wildforster | 81/489 |
| 5,615,455 | A | | 4/1997 | Sorensen et al. | |
| 5,722,116 | A | | 3/1998 | Lin et al. | |
| 5,781,963 | A | | 7/1998 | Maru et al. | |
| 5,956,799 | A | | 9/1999 | Panuccione et al. | |
| 5,964,009 | A | | 10/1999 | Hoepfl et al. | |
| 6,295,904 | B1 | | 10/2001 | Webb | |
| 6,345,556 | B1 | | 2/2002 | Lin | |
| 6,378,402 | B1 | | 4/2002 | Kalomeris et al. | |
| 6,421,860 | B1 | | 7/2002 | Abbott | |
| 6,471,186 | B1 | | 10/2002 | Lawless | |
| RE38,093 | E | | 4/2003 | Chiou | |
| 2002/0134971 | A1 | | 9/2002 | Christensen | |

* cited by examiner

*Primary Examiner*—Robert C. Watson
(74) *Attorney, Agent, or Firm*—Lackenbach Siegel, LLP

(57) ABSTRACT

A pry bar has generally octagonal cross-section handle with a grip portion having four rounded surfaces formed of a soft elastomeric material and four alternating surfaces formed of hard thermoplastic material. The elastomeric material rounded surfaces are formed with pluralities of small orifices. The handle is formed with an inner hard thermoplastic core and molded over outer elastomeric cover. A metal impact cap is fixed secured in the handle proximate end.

67 Claims, 3 Drawing Sheets

FIG.4
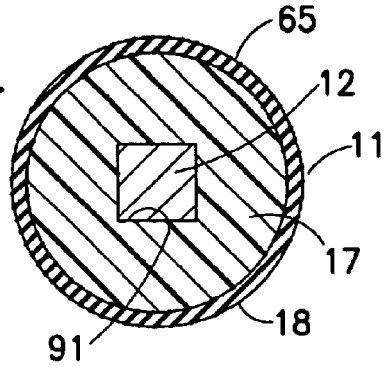
FIG.5
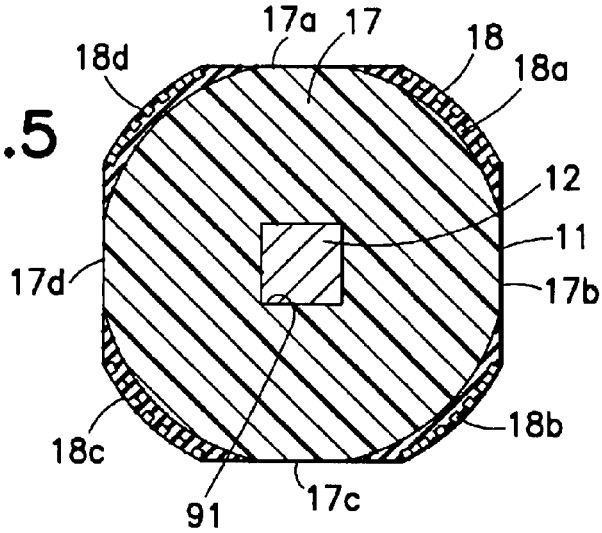
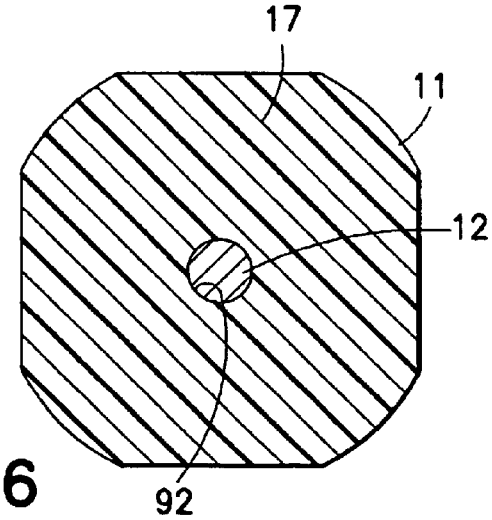
FIG.6

PRY BAR HANDLE

FIELD OF THE INVENTION

This invention relates to hand tools and hand tool handles. This invention specifically relates to pry bars and pry bar handles. This invention specifically relates to an ergonomic handle for hand tools particularly a pry bar.

BACKGROUND AND DISCUSSION OF THE PRIOR ART

In general, pry bars are of all metal construction and are cumbersome to grip and use. Often the user has to grip a polygonal cross-sectional metal bar portion of the pry bar. One such prior art construction is disclosed in U.S. Pat. No. 6,058,809 to Flanz.

A wrecking tool is disclosed in U.S. Patent application Publication No. 2002/0134971 to Christensen. The Christensen tool has an elongate octagonal cross-sectional metal handle or bar stock portion. A non-octagonal handgrip is attached to the octagonal metal bar.

It is generally known to provide a soft elastomeric molded over cover on a molded hard thermoplastic core for improved grip for knives, screwdrivers, and the like bladed tools. Such prior art constructions are disclosed in Sanelli, U.S. Pat. No. 4,712,304; Gakhar, U.S. Pat. No. 5,390,572; Hoepfl, U.S. Pat. No. 5,964,009; and Panaccione, U.S. Pat. No. 5,956,799.

The pry bar art desires an improved handle so as to provide improved grip with ergonomic functionality.

It is therefore a principal object of the present invention to provide an ergonomic handle for hand tool such as a pry bar.

It is another object of the present invention to provide an improved grip hand tool and pry bar handle.

It is still a further object of the present invention to provide an ergonomic pry bar handle that is of practical design and safe and practical in use.

Present applicant is the inventor of the ergonomic pry bar handle disclosed in U.S. Pat. No. 6,471,186, granted Oct. 29, 2002, which patent and the present application are commonly assigned to Mayhew Steel Products, Inc.

SUMMARY OF THE INVENTION

A pry bar has a handle with a generally octagonal cross-section with eight grip surfaces. Four of the grip surfaces have hard thermoplastic planar surfaces and four alternating grip surfaces have rounded soft thermoplastic material surfaces. The rounded soft thermoplastic material surfaces have a plurality of rows of small orifices. The user grips the alternating surfaces for a secure ergonomic grip in pry bar operations.

BRIEF DESCRIPTION OF THE DRAWINGS

FIG. 4 is a sectional view taken along line 4—4 of FIG. 3;

FIG. 5 is a sectional view taken along line 5—5 of FIG. 3; and

FIG. 6 is a sectional view taken along line 6—6 of FIG. 3.

DESCRIPTION OF THE PREFERRED EMBODIMENT

Figure 1:
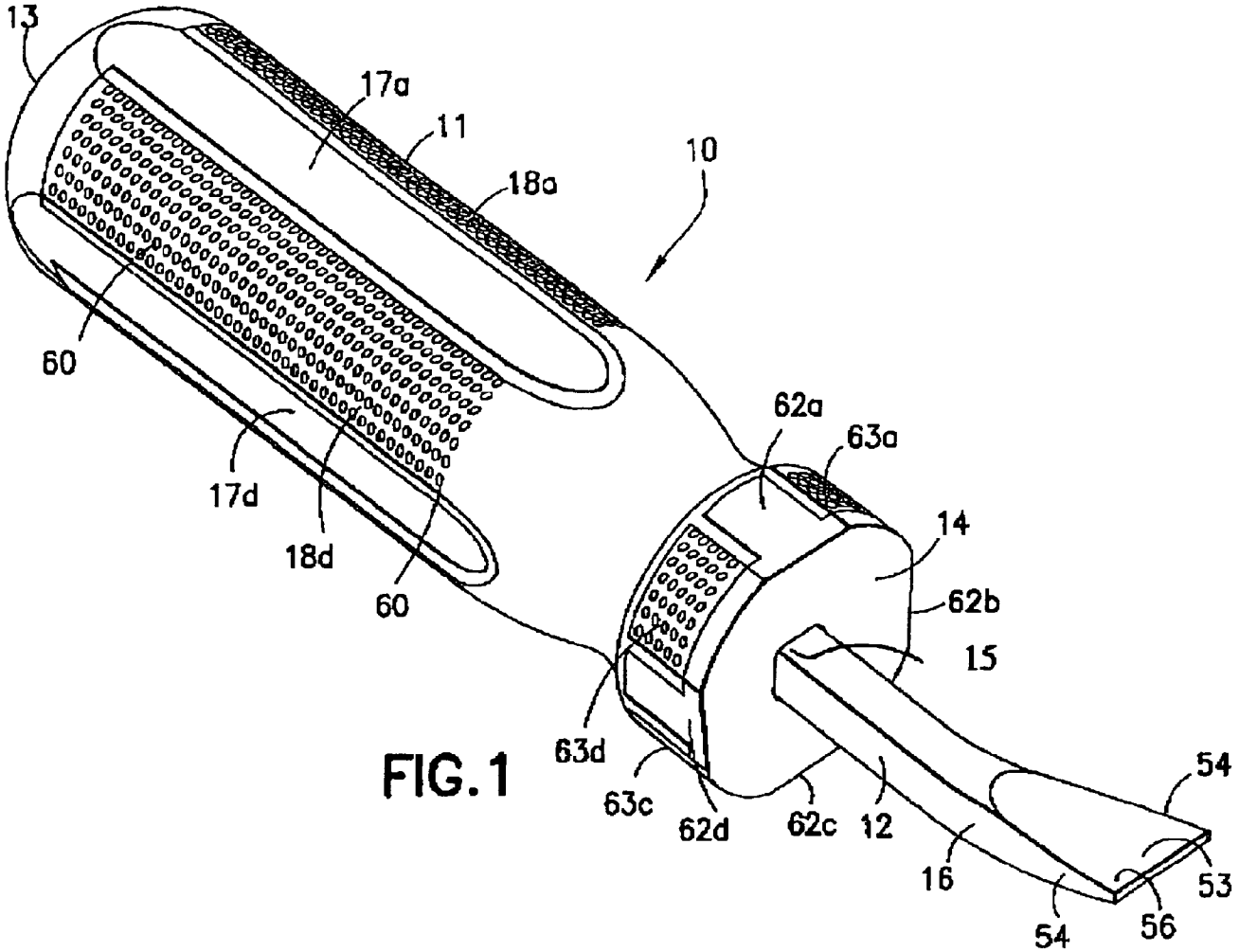
FIG. 1 is a distal end perspective view of the pry bar having the ergonomic handle of the present invention.

Referring to FIGS., there is shown pry bar 10 of the present invention. Pry bar 10, in general terms, includes handle 11 and a fixedly attached metal blade or shank 12. Handle 11 has a proximate end 13 and a planar distal end 14. Blade 12 has a proximate end 15 and a distal end 16. Handle 11 is formed of a hard thermoplastic molded core 17 and a molded over integrally bonded elastomeric soft grip cover 18, wherein cover 18 is formed of relatively soft elastomeric material. The proximate end 15 of blade 12 is securely fixedly molded in core 17, with the formation of core 17. The elastomeric cover 18 is then molded over or around specific portions of the core 17, as further discussed hereinafter. Blade 12 is of generally square cross-sectional bar stock construction and has a proximate end 15 and a distal end 16. Proximate end 15 is molded in situ with core 17, so as to be fixedly secured within handle 11, by means well known in the art.

A metal impact cap 50 is fixedly disposed at the distal end of the handle 11. Cap 50 is secured within the handle core 17 by means well known in the screwdriver handle art. Cap 50 is used, by way of example, to impact screw heads prior to driving same. In molding handle core 17 around blade 12 a rectilinear hole 91 is formed in the handle distal end. The proximate end of core 17 is however formed with a circular cylindrical hole 92 for forcibly fixedly holding metal cap 50 in the handle proximate end.

Blade distal end 16 is formed with a pry end 53. Pry end 53 has outwardly tapered sides 54, and upper and lower surfaces 56 and 57. Surfaces 56 and 57 are tapered and extend towards sharpened edge or tip 58. Tip 58 is upwardly angularly disposed with respect to shank 12.

The elastomeric cover 18 does not cover the entire core 17. Four planar thermoplastic surfaces 17*a*–17*d* are left uncovered in the grip area of the handle, as best shown in FIG. 5.

Figure 2:
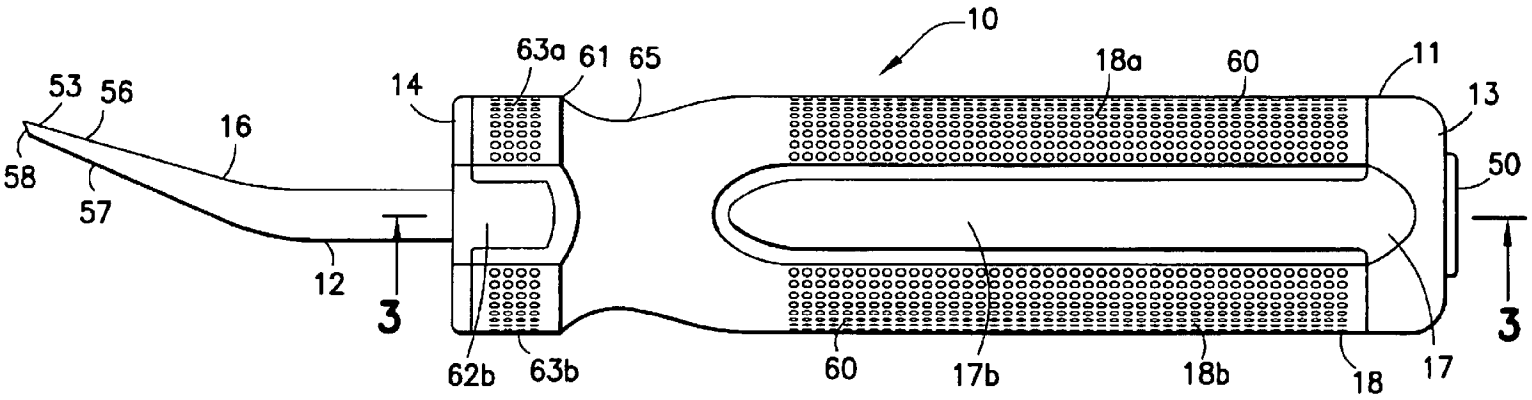
FIG. 2 is a side elevational view of the pry bar of FIG. 1.

Elastomeric material cover 18 is molded over hard thermoplastic core 17 in the handle grip portion in four curved or rounded grip portions 18*a*–18*d*, as best shown in FIGS. 2 and 5. The rounded elastomeric grip portions 18*a*–18*d* alternate with the planar hand plastic grip portions 17*a*–17*d*. Elastomeric grip portions 18*a*–18*d* are formed with a plurality of rows of small crevices or holes 60 (typical). It is believed that the surfaces 17*a*–17*d*, 18*a*–18*d* in further combination with the small holes provides improved grip and comfort for the user.

Figure 3:
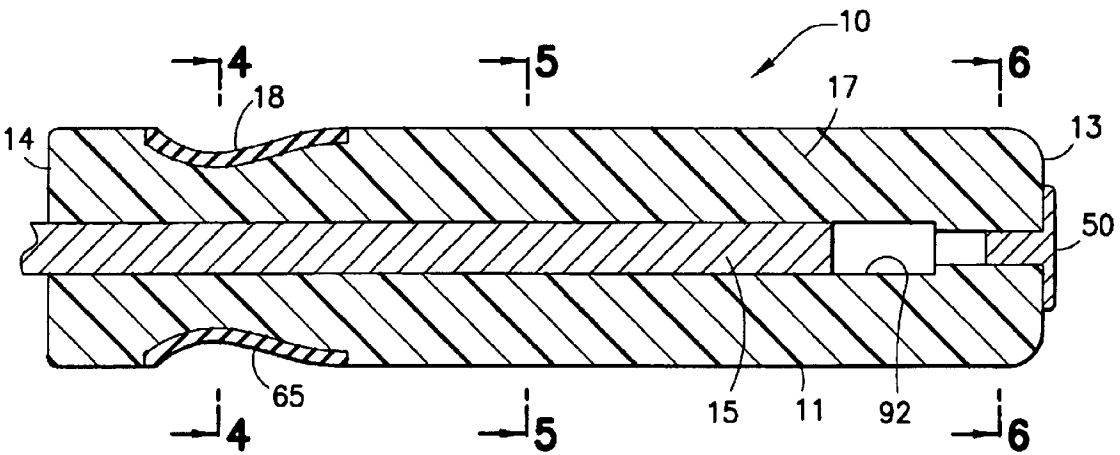
FIG. 3 is a sectional view taken along line 3—3 of FIG. 2.

Handle 11 is formed with a distal end portion 61 juxtaposed to planar end 14. Distal end portion 61 is formed with alternate hard plastic planar surfaces 62*a*–62*d*, and elastomeric rounded surface 63*a*–63*d* which are formed and configured similarly to respective surfaces 17*a*–17*d* and 18*a*–18*d*. Elastomeric cover 18 extends from grip portions 18*a*–18*d* to respective distal end portions 63*a*–63*d* and entirely covers thermoplastic core 17 at cylindrical cross-sectional recessed portion 65, as best shown in FIGS. 2, 3 and 4.

In the aforesaid manner of construction, the user grips portions 18*a*–18*d* and 17*a*–17*d* and places the thumb in recessed portion 65, or if desired, on one of the distal end surfaces 63*a*–63*d* for best desired grip and comfort.

The core may be molded of hard thermoplastic using and the cover may be molded of with elastomeric material by molding methods.

The afore-discussed handle surfaces and contours, and in conjunction with the pry bar configuration and disposition with respect to the handle, provides an ergonomic pry bar.

The invention contemplates an ergonomic handle for both pry bar and other hand tools.

In the aforesaid manner of construction, there is provided a ergonomic pry bar and handle.

While the foregoing describes certain embodiments of the invention, various modifications and changes may be made within the spirit and scope of the invention, as defined by the adjoined claims.

What is claimed is:

1. A pry bar comprising:

a handle having a distal end, a proximate end and a grip portion;

said grip portion having a generally octagonal cross-section;

said handle further comprising:

an inner thermoplastic core and an outer integrally bonded elastomeric material;

a longitudinally extending bore through said thermoplastic core;

a pry bar blade, said blade having a proximate end and a distal end;

said blade proximate end being disposed within said handle in said bore;

said blade being elongate and having a longitudinal axis;

said blade distal end being formed with a pry end;

said pry end being in angular disposition with respect to said blade longitudinal axis;

a metal impact cap fixedly disposed in said handle at said handle proximate end; and the blade proximate end is adjacent to and facingly disposed to the metal impact cap.

2. The pry bar of claim 1, said grip portion having an outer surface comprising eight grip surfaces.

3. The pry bar of claim 2, four of said grip surfaces comprising said thermoplastic material.

4. The pry bar of claim 3, four of said grip surfaces comprising said elastomeric material.

5. The pry bar of claim 4, said thermoplastic material grip surfaces alternating with said elastomeric material grip surfaces.

6. The pry bar of claim 3, said elastomeric material grip surfaces being formed with a plurality of orifices.

7. The pry bar of claim 4, said thermoplastic material grip surfaces being planar.

8. The pry bar of claim 1, said handle further comprising a distally disposed portion comprising elastomeric material grip surfaces being formed with a plurality of orifices.

9. The pry bar of claim 8, said handle distally disposed portion elastomeric material grip surfaces being rounded.

10. The pry bar of claim 1, wherein the thermoplastic material is harder than the elastomeric material.

11. The pry bar of claim 1, wherein the handle comprises a cylindrical cross-sectional recessed portion.

12. The pry bar of claim 11, wherein the handle recessed portion has an outer surface substantially covered by the elastomeric material.

13. The pry bar of claim 2, wherein each of the eight grip surfaces is one of a planar and a contoured surface.

14. The pry bar of claim 3, wherein each thermoplastic material grip surface extends from the handle proximate end substantially to the handle distal end.

15. The pry bar of claim 4, wherein each elastomeric material grip surface extends from the handle distal end substantially to the handle proximate end.

16. The pry bar of claim 4, wherein at least one grip surface comprises the elastomeric material, said at least one grip surface further comprising a discontinuous surface of elastomeric material.

17. The pry bar of claim 16, wherein the discontinuous surface extends from the distal end to substantially to the proximate end.

18. The pry bar of claim 16, wherein the discontinuous surface is elongated.

19. A pry bar comprising:

a handle having a distal end, a proximate end, and a medial grip portion cross-sectional shape with at least four sides;

said handle comprising:

an thermoplastic material inner core and an outer integrally bonded elastomeric material;

said inner core defining a longitudinally extending through bore;

an elongate blade having a proximate end, a distal end, and a longitudinal axis, said blade proximate end being disposed within said handle bore, said blade distal end being formed with a pry end, and said pry end being in angular disposition with respect to said blade longitudinal axis;

a metal impact cap disposed at the handle proximate end; and the blade proximate end is adjacent to and facingly disposed to the metal impact cap.

20. The pry bar of claim 19, wherein the handle distal end has a generally octagonal cross-section.

21. The pry bar of claim 19, wherein the handle comprises a cylindrical cross-sectional recessed portion.

22. The pry bar of claim 21, wherein the handle recessed portion has an outer surface entirely covered by the elastomeric material.

23. The pry bar of claim 19, where: the handle having an outer surface comprising a plurality of grip surfaces, wherein each of the grip surfaces is one of a planar and a or contoured surface.

24. The pry bar of claim 19, the thermoplastic material inner core comprising an outer grip surface extending from the handle proximate end substantially to the handle distal end.

25. The pry bar of claim 19, the elastomeric material comprising an outer grip surface extending from the handle distal end substantially to the handle proximate end.

26. The pry bar of claim 19, a thermoplastic material inner core outer grip surface extends from the handle proximate end substantially to the handle distal end, and a elastomeric material outer surface extends from the handle distal end substantially to the handle proximate end.

27. The pry bar of claim 19, the thermoplastic material inner core comprises a first outer grip surface, and the elastomeric material comprises a second outer grip surface, the elastomeric second outer grip surface being discontinuous.

28. The pry bar of claim 27, wherein the discontinuous surface is elongated.

29. The pry bar of claim 19, the handle distal end comprising an end portion having a plurality of sides.

30. The pry bar of claim 29, the end portion sides comprising oppositely disposed planar sides.

31. The pry bar of claim 30, the planar sides comprising the thermoplastic material.

32. The pry bar of claim 29, the end portion sides comprising oppositely disposed arcuate sides.

33. The pry bar of claim 19, wherein the thermoplastic material inner core is harder than the elastomeric material.

34. A pry bar comprising:

a handle having a distal end, a proximate end, and a cross-sectional shape having at least four sides;

said handle comprising:

an inner thermoplastic core defining a longitudinally extending through bore, an outer integrally bonded elastomeric material, and a metal impact cap fixably disposed at the handle proximate end; and an elongate blade having a proximate end, a distal end, and a longitudinal axis, said blade proximate end being disposed within said handle, said blade distal end being formed with a pry end, and said pry end being in angular disposition with respect to said blade longitudinal axis;

the handle distal end adjacent to and facingly disposed to the metal impact cap.

35. The pry bar of claim 34, the handle proximate end and metal impact cap each having respective cross-dimensions, the metal impact cap cross-dimension being less than handle proximate end cross-dimension.

36. The pry bar of claim 34, wherein the metal impact cap comprises a disk shape.

37. The pry bar of claim 34, the metal impact cap comprising an impact surface and an arcuate edge, whereby the impact surface is disposed adjacent to the handle proximate end.

38. The pry bar of claim 34, wherein the metal impact cap comprising an arcuate impact surface having a width and an arcuate side edge having a height, the width of the arcuate impact surface being greater than the height of the arcuate side edge, whereby the impact surface is disposed adjacent to the handle proximate end.

39. The pry bar of claim 34, wherein the blade proximate end is adjacent to and facingly disposed the metal impact cap.

40. A pry bar comprising:

a handle having a distal end, a proximate end;

said handle further comprising:

at least a thermoplastic material defining a longitudinally extending through bore;

first opposed grip surfaces comprising a thermoplastic material, and second opposed grip surfaces comprising an elastomeric material, wherein the second grip surfaces are convex; and an elongate blade having a proximate end, a distal end, and a longitudinal axis, said blade proximate and being disposed within said handle through bore, said blade distal end being formed with a pry end, and said pry end being in angular disposition with respect to said blade longitudinal axis a metal impact cap fixedly disposed to said handle at said handle proximate end, whereby said metal impact cap enables non-destructive application of a hard striking force to said pry bar; and the blade proximate end is adjacent to and facingly disposed to the metal impact cap, whereby said metal impact cap and said handle enable an easy transfer of said hard striking force to said elongate blade.

41. The pry bar of claim 40, further comprising third opposed grip surfaces comprising the thermoplastic material, and fourth opposed grip surfaces comprising the elastomeric material, wherein the fourth grip surfaces are convex.

42. The pry bar of claim 41, wherein the handle has a medial grip portion comprising a generally octagonal cross-section.

43. The pry bar of claim 40, wherein the first opposed grip surfaces are planar and alternate with the second opposed grip surfaces, whereby the handle comprises alternating surfaces comprising the thermoplastic material and the elastomeric material.

44. The pry bar of claim 40, the handle distal end comprises an end portion having a plurality of sides; and said plurality of sides further comprising at least one set of oppositely disposed planar sides and one set of oppositely disposed arcuate sides; and said planar sides comprising the thermoplastic material.

45. A pry bar comprising:

a handle having a distal end, a proximate end, and at least four elongated grip surfaces;

said handle further defining a longitudinally extending through bore two of the elongated grip surfaces further comprising a thermoplastic material, and two of the grip surfaces comprising an elastomeric material;

an elongate blade having a proximate end, a distal end, and a longitudinal axis;

said blade proximate and being disposed within said handle through bore, said blade distal end being formed with a pry end;

said pry end being in angular disposition with respect to said blade longitudinal axis;

a metal impact cap fixedly disposed at said handle proximate end, thereby enabling non-destructive application of a hard striking force to said pry bar; and said blade proximate end is adjacent to and facingly disposed to said metal impact cap, whereby said metal impact cap and said handle enable easy transfer of said hard striking force to said elongate blade.

46. The pry bar of claim 45, wherein the thermoplastic material is harder than the elastomeric material.

47. The pry bar of claim 45, the two thermoplastic material grip surfaces being in oppositely disposed disposition.

48. The pry bar of claim 45, the two elastomeric material grip surfaces being in oppositely disposed disposition.

49. The pry bar of claim 45, the two thermoplastic material grip surfaces being in oppositely disposed disposition, and the two elastomeric material grip surfaces being in oppositely disposed disposition.

50. The pry bar of claim 45, wherein the grip surfaces alternate between the thermoplastic material grip surfaces and the elastomeric material grip surfaces.

51. The pry bar of claim 45, the handle distal end comprising an end portion having a plurality of sides.

52. The pry bar of claim 51, the handle distal end portion sides comprising oppositely disposed planar sides.

53. The pry bar of claim 52, the planar sides comprising the thermoplastic material.

54. The pry bar of claim 51, the handle distal end portion sides comprising oppositely disposed arcuate sides.

55. A pry bar comprising:

a handle having a distal end, a proximate end, and at least four elongated grip surfaces;

said handle defining a longitudinally extending through bore;

a first set of two of the elongated grip surfaces comprising a first specific grip surface configuration;

a second set of and two of the elongated grip surfaces comprising a second specific grip surface configuration;

an elongate blade;

said elongate blade further comprising:

a proximate end, a distal end, and a longitudinal axis;

said blade proximate end being disposed within said handle through bore;

said blade distal end being formed with a pry end;

said pry end being in angular disposition with respect to said blade longitudinal axis;

a metal impact cap fixedly disposed at the handle distal end;

said handle being formed with a longitudinally extending bore;

said blade proximate end and said metal impact cap being facingly disposed in said bore, whereby a hard striking force to said metal impact cap is transferred to said pry end without damage to said pry bar.

56. The pry bar of claim 55, wherein the first specific grip surface configuration comprises a hard thermoplastic material.

57. The pry bar of claim 56, the two thermoplastic material grip surfaces being in oppositely disposed disposition.

58. The pry bar of claim 55, wherein the second specific grip surface configuration comprises a soft elastomeric material.

59. The pry bar of claim 58, the two elastomeric material grip surfaces being in oppositely disposed disposition.

60. The pry bar of claim 55, wherein the grip surfaces alternate between the first specific grip surface configuration and the second specific grip surface configuration.

61. A pry bar comprising:

a handle having a distal end, a proximate end, and a medial grip portion;

said handle comprising:

an inner thermoplastic core, a common internal bore extending through the thermoplastic material inner core and open at both the handle distal and proximate ends, an outer integrally bonded elastomeric material, and a metal impact cap fixedly disposed in the bore from the handle proximate end;

said metal impact cap comprising a disk shape effective to receive withstand and transmit a hard impact force to said handle without damaging said handle;

the metal impact cap comprising an impact surface for receiving said hard impact force and an arcuate edge, wherein the impact surface is adjacent to the handle proximate end;

an elongate blade having a proximate end, a distal end, and a longitudinal axis, said blade proximate end being disposed in the bore from the handle distal end, said blade distal end being formed with a pry end; and said pry end being in angular disposition with respect to said blade longitudinal axis, wherein said blade proximate end is adjacent to the metal impact cap in the common bore.

62. The pry bar of claim 61, the handle proximate end and metal impact cap each having respective cross-dimensions, the metal impact cap cross-dimension being less than handle proximate end cross-dimension.

63. The pry bar of claim 61, wherein the metal impact cap comprises an arcuate impact surface having a width and an arcuate side edge having a height, the width of the arcuate impact surface being greater than the height of the arcuate side edge, whereby the impact surface is adjacent to the handle proximate end.

64. The pry bar of claim 61, wherein:

the medial grip portion comprising a plurality of elongated grip surfaces, the elongated grip surfaces being alternating arcuate and planar surfaces, the arcuate grip surfaces comprising the elastomeric material and the planar surfaces comprising the thermoplastic material, the arcuate grip surfaces comprising discontinuous elastomeric material surfaces.

65. A pry bar comprising:

a handle having a distal end and a proximate end;

said handle comprising an inner thermoplastic core defining a longitudinal through bore, an outer elastomeric material integrally bonded to the inner thermoplastic core, and a metal impact cap disposed on the handle proximate end;

an elongate blade having a proximate end, a distal end, and a longitudinal axis;

said blade proximate end being disposed in the handle distal end, said blade distal end being formed with a pry end, and said pry end being in angular disposition with respect to said blade longitudinal axis, wherein the inner thermoplastic core extends from the blade proximate end to the metal impact cap;

said inner thermoplastic core is formed defining a space between the blade proximate end and said metal impact cap along said through bore; and said space is substantially free of said thermoplastic material, whereby a manufacturing ease of said pry bar is improved.

66. The pry bar according to claim 65, the handle proximate end further comprising a planar surface, and the impact cap comprising a distal planar surface facingly disposed to the handle proximate planar surface.

67. The pry bar according to claim 65, the handle comprising a medial grip surface that comprises an uninterrupted thermoplastic surface extending from the handle proximate end to the handle distal end.

* * * * *